US011910847B2

(12) United States Patent
Ford

(10) Patent No.: US 11,910,847 B2
(45) Date of Patent: Feb. 27, 2024

(54) NURSING BRASSIERES

(71) Applicant: Denise Ford, El Paso, TX (US)

(72) Inventor: Denise Ford, El Paso, TX (US)

( * ) Notice: Subject to any disclaimer, the term of this patent is extended or adjusted under 35 U.S.C. 154(b) by 98 days.

(21) Appl. No.: 17/869,312

(22) Filed: Jul. 20, 2022

(65) Prior Publication Data

US 2023/0025217 A1 Jan. 26, 2023

Related U.S. Application Data

(60) Provisional application No. 63/224,607, filed on Jul. 22, 2021.

(51) Int. Cl.
*A41C 3/04* (2006.01)

(52) U.S. Cl.
CPC ..... *A41C 3/04* (2013.01)

(58) Field of Classification Search
CPC ..... A41C 3/04
USPC ..... 450/36
See application file for complete search history.

(56) References Cited

U.S. PATENT DOCUMENTS

2006/0154566 A1* 7/2006 Nunez ..... A41C 3/0064 450/37
2018/0214066 A1* 8/2018 Goodall ..... A61B 5/1077
2018/0296741 A1* 10/2018 Hill ..... A61M 1/062
2018/0326130 A1* 11/2018 Thompson ..... A61M 1/06

* cited by examiner

*Primary Examiner* — Gloria M Hale
(74) *Attorney, Agent, or Firm* — Barry Choobin; Patent 360

(57) ABSTRACT

A nursing brassiere for lactating women that allows hands-free use of breast pumps. The nursing brassiere further has heating coils integrated within the fabric of the nursing brassiere wherein the heating coils are configured to apply therapeutic heat to one or both breasts while simultaneously using one or two breast pumps.

14 Claims, 2 Drawing Sheets

NURSING BRASSIERES

CROSS-REFERENCE TO RELATED APPLICATIONS

This application claims priority from a U.S. Provisional Patent Appl. No. 63/224,607 filed on 22 Jul. 2021, which is incorporated herein by reference in its entirety.

FIELD OF INVENTION

The present invention relates to nursing brassieres, and more particularly, the present invention relates to nursing brassieres for hands-free use of a breast pump/breastfeeding and therapeutic heat application.

BACKGROUND

Lactating women everywhere often struggle with issues such as decreased milk supply, clogged milk ducts, painful infections and abscesses, and mastitis. Breast pumps are often advised in such conditions for increased expression of breast milk. However, using breast pumps is both time-consuming and laborious. The nursing mother must hold the breast pump in their hand against an exposed portion of the breast for a prolonged duration. Often, the milk must be simultaneously expressed from both breasts, and thus two breast pumps must be used simultaneously that occupy both hands.

The prior art teaches nursing and pumping brassieres that allow hand-free use of the breast pumps, either single or two breast pumps simultaneously. The breast pumps alone however are often inefficient. The expression of milk using the breast pumps is often insufficient and use is painful. The nursing mothers must also take other therapies to increase milk supply, and treat clogged milk ducts, painful infections and abscesses, and mastitis. However, the use of such therapies is time-consuming and burdensome, and often nursing mothers may not get time for such alternate therapies.

A need is therefore appreciated for a device that allows nursing mothers hands-free use of breast pumps and simultaneously take additional therapies.

SUMMARY OF THE INVENTION

The following presents a simplified summary of one or more embodiments of the present invention to provide a basic understanding of such embodiments. This summary is not an extensive overview of all contemplated embodiments and is intended to neither identify critical elements of all embodiments nor delineate the scope of any or all embodiments. Its sole purpose is to present some concepts of one or more embodiments in a simplified form as a prelude to the more detailed description that is presented later.

The principal object of the present invention is therefore directed to nursing brassiere for hands-free use of breast pumps and simultaneous heat therapy.

It is another object of the present invention that the therapeutic heat application increases milk expression.

It is still another object of the present invention that the therapeutic heat application provides relief for clogged milk ducts, painful infections and abscesses, and mastitis.

It is a further object of the present invention that the nursing brassiere saves time and labor.

It is yet another object of the present invention that the amount of heat application can be controlled.

It is a further object of the present invention that the nursing brassiere is soft, durable, adjustable, and comfortable to wear.

It is still a further object of the present invention that the nursing brassiere assists with relaxing milk ducts to increase milk letdown for breastfeeding women.

It is an additional object of the present invention that the nursing brassiere offers a viable preventative treatment for clogged milk ducts, mastitis, and decreased milk supply.

BRIEF DESCRIPTION OF THE DRAWINGS

The accompanying figures, which are incorporated herein, form part of the specification and illustrate embodiments of the present invention. Together with the description, the figures further explain the principles of the present invention and to enable a person skilled in the relevant arts to make and use the invention.

DETAILED DESCRIPTION

Figure 1:
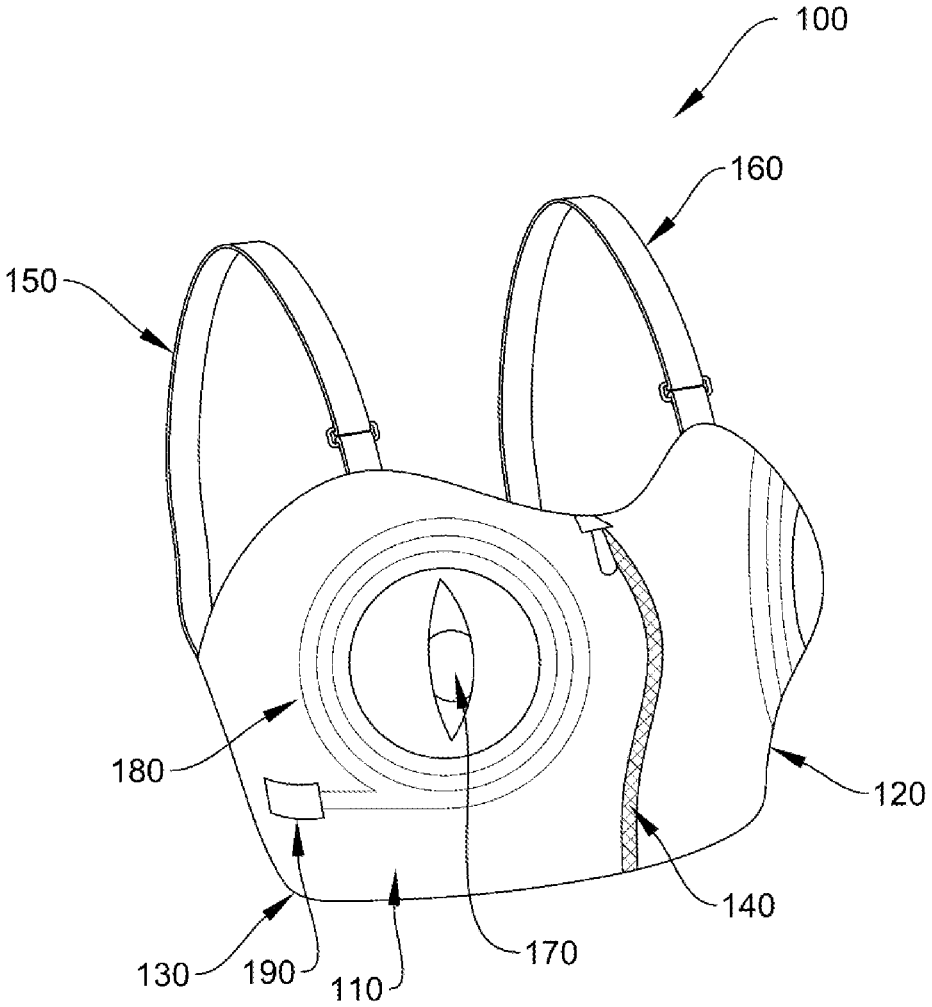
FIG. 1 is a perspective view of a nursing brassiere, according to an exemplary embodiment of the present invention.

Subject matter will now be described more fully hereinafter. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, reasonably broad scope for claimed or covered subject matter is intended. Among other things, for example, the subject matter may be embodied as apparatus and methods of use thereof. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage, or mode of operation.

The terminology used herein is to describe particular embodiments only and is not intended to be limiting of embodiments of the invention. As used herein, the singular forms "a", "an", and "the" are intended to include the plural forms as well, unless the context indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely to illustrate the general principles of the invention since the scope of the invention will be best defined by the allowed claims of any resulting patent.

The following detailed description is described with reference to the drawings, wherein reference numerals are used to refer to like elements throughout. In the following description, for purposes of explanation, specific details may be outlined to provide a thorough understanding of the subject innovation. It may be evident, however, that the claimed subject matter may be practiced without these specific details. In other instances, well-known structures and apparatus are shown in block diagram form to facilitate describing the subject innovation. Moreover, the drawings may not be to scale.

Disclosed is a nursing brassiere that allows the nursing mothers hands-free use of one or two breast pumps simultaneously. Moreover, the disclosed nursing brassiere can provide for therapeutic heat application to one or both breasts in a controlled manner and while using the breast pump. The use of breast pumps and therapeutic heat application can be independent, the nursing mother can apply the therapeutic heat without the breast pump.

Referring to FIG. 1 which shows an exemplary embodiment of the disclosed nursing brassiere 100. The disclosed nursing brassiere can be dimensioned similar to a standard sports bra and made in standard sizes known for a sports bra. For example, the disclosed nursing brassiere can be made in small, medium, and large sizes. The material used in making the disclosed nursing brassieres can be any standard material known for use in standard brassieres including Lycra, elastane, or a combination of two or more materials. Any such material for making the disclosed nursing brassiere is within the scope of the present invention. Preferably, the material can be soft and stretchy. The disclosed nursing brassiere can include a left section 110 and a right section 120. The left section can cover at least the left breast and the right section can cover at least the right breast.

A stretchable band 130 extends from the edges of the left section and the right section, respectively. The stretchable band can be elongated in dimension and can have a proximal end and a distal end along the length of the stretchable band. The proximal end can be coupled to the left section and the distal end can be coupled to the right section of the nursing brassiere. The stretchable band helps to secure the disclosed nursing brassiere wherein the stretchable band extends across the back of the wearer.

The left section and the right section can be separate to allow a user to easily wear the disclosed nursing brassiere. The left section and the right section can be joined by a zipper 140 or similar fastening mechanism. For example, other fasteners, such as a hook and loop fastener are within the scope of the present invention. The zipper can be used conveniently to fasten the left section and the right section together. The user can wear the disclosed nursing brassiere and can then zip the zipper to secure the nursing brassiere over the chest.

The nursing brassiere can further include two shoulder straps i.e., a left shoulder strap 150 and a right shoulder strap 160. The left shoulder strap can extend from the left section to the stretchable band. Similarly, the right shoulder strap can extend from the right section to the stretchable band.

Each of the left and right sections can have a hole 170 that provides an access to the respective nipple. The hole can be stretchable which allows the flange of a breast pump to pass through and fit over the nipple portion of the breast. The periphery of the holes can be durable to hold the breast pump secured against the breast. Optionally, the periphery of the holes can be reinforced with elastic material to securely hold the flanges of the breast pumps and at the same time expand to allow the flange to be inserted through the holes. Flaps can be used to cover the holes, as and when desired.

Each of the left section and the right section can include heating coils 180 integrated within the fabric of the left section and the right section. The heating coils can be sandwiched between the fabric to prevent direct exposure to the heating coils. The inner fabric can conduct the heat to the skin of the breast and diffuse the heat for uniform application of the heat to the breast. The heating coils can be waterproofed, such that the disclosed nursing brassiere can be washed without harming the heating coils. Moreover, the heating coils can be stretchable that can expand with the stretchable fabric of the brassiere without any damage to the heating coils. The heating coils can be radially arranged to match the contours of the breast and the positioning of the heating coils can be further optimized for maximum heat application without departing from the scope of the present invention. The heating coil can be connected to an input port, the input port further integrated to a bracket, the bracket coupled to the left section, right section, or the stretchable band. The inlet port can also be waterproofed to prevent any damage due to water.

The nursing brassiere can further include a control unit and a battery enclosed in a casing, wherein the casing can be coupled to the bracket. The power supply can connect to the inlet port for supplying power to the heating coils. The casing can be removed as and when desired, for example for charging the battery or washing the nursing brassiere.

The control unit can also be paired with an external device such as a remote control or a smartphone. The control unit can include a network circuitry for connecting to the external device. The network circuitry may allow either a wired connection or a wireless connection or both. For example, the external device can be connected using a Bluetooth connection.

The external device can be used to send an instruction to the control unit such as adjusting the level of heating, duration of heating, and the like. The control unit can also be configured to display the battery status, temperature information, and the like on the external device. In one implementation, a display and control panel can be provided in the casing itself. In one implementation, a pouch 190 can be provided in place of a bracket. Either the pouch and the bracket can be positioned such that not to interfere with arm movements or obstruct the movement of the arm.

Figure 2:
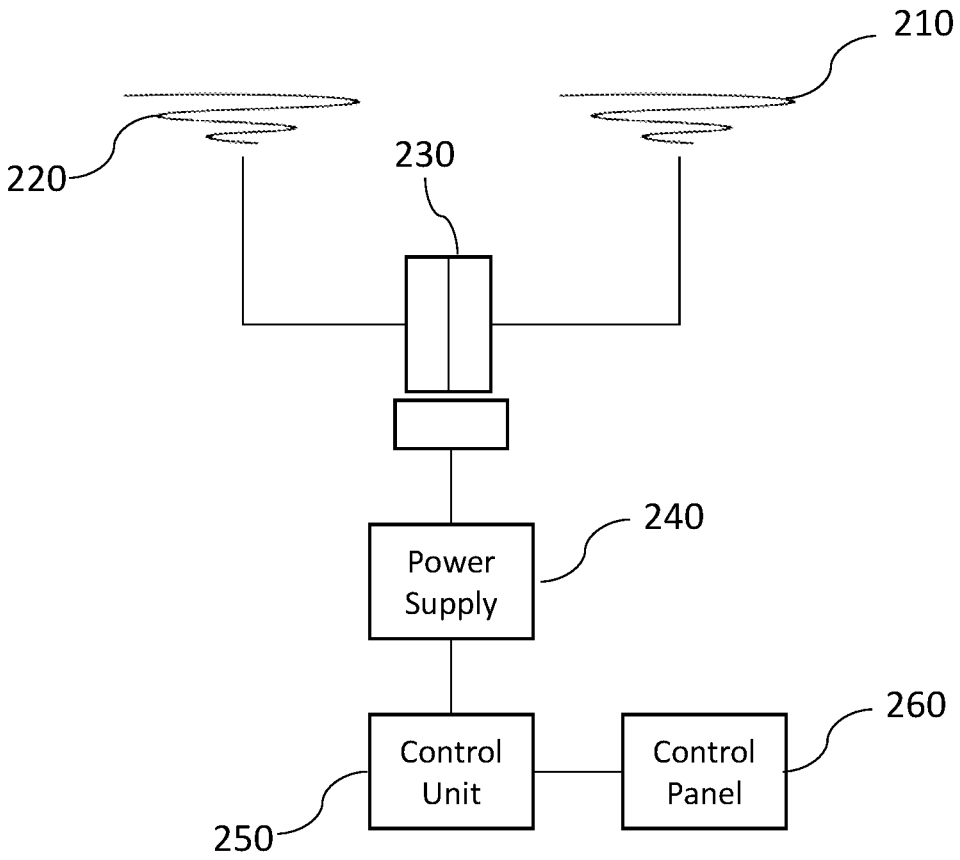
FIG. 2 is a block diagram showing certain embodiments of the nursing brassiere, according to an exemplary embodiment of the present invention.

Referring to FIG. 2 which shows a left heating coil 210, a right heating coil 220, an inlet port 230 connected to the left heating coil 210 and the right heating coil 220. A power supply 240 that can be connected to the inlet port using a socket or similar interface. A control unit 250 can be coupled to the power supply for regulating the flow of power to the heating coils. A control panel 260 is coupled to the control unit for providing input. For example, a knob can be provided as an interface for the control panel, wherein the knob can be rotated between low, medium, and high for three levels of heating.

In one implementation, the zipper can be provided with a fabric flange behind the teeth of the zipper to prevent contact of the teeth with the skin of the wearer in order to prevent any injury to the skin or discomfort.

In one implementation, the heating coils like those used in heating blankets can be used without departing from the scope of the present invention.

In one implementation, the bracket can be replaced by a pouch sewn on the outer surface of the fabric of the nursing brassier. The casing can be inserted into the pouch and secured. For example, the pouch can be made from stretchable material to grip the casing.

In one implementation, extra fabric layers can be provided and sewn to keep the metal loops from having direct contact with the skin for added protection from potential burns. The coils can be evenly distributed throughout the cloth material to ensure even application of heat. The disclosed nursing brassiere can warm up the woman's milk ducts when pumping, allowing for enhanced milk production and prevention of issues such as clogged milk ducts. The exact size, measurement, construction, and design specifications may vary upon further development and manufacturing.

In one implementation, the heating coils of either the left section or the right section can be turned on and off by the control unit.

In one implementation, the stretchable band, the left shoulder strap, and the right shoulder strap can have length adjustment mechanisms, such as hook and loop fasteners, which allow adjusting the effective lengths of the stretchable band, the left shoulder strap, and the right shoulder strap.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. A nursing brassiere comprising:

a left section configured to cover a left breast of a wearer;

a right section configured to cover a right breast of the wearer;

each of the left section and the right section has a hole configured to allow a flange of a breast pump to pass through and fit over the respective breast; and each of the left section and the right section has heating coils integrated within a fabric of the left section and the right section respectively, the heating coils are configured to apply therapeutic heat to the respective breast.

2. The nursing brassiere according to claim 1, wherein the heating coils are waterproofed.

3. The nursing brassiere according to claim 2, wherein the heating coils are stretchable.

4. The nursing brassiere according to claim 1, wherein the nursing brassiere further comprises:

an inlet port coupled to the heating coils of the left section and the right section; and a power supply configured to removably coupled to the inlet port for powering the heating coils.

5. The nursing brassiere according to claim 4, wherein the nursing brassiere further comprises:

a casing, wherein the power supply is encased within the casing, wherein the power supply comprises one or more batteries; and a control unit encased within the casing, the control unit is configured to control an amount of power supplied to the heating coils.

6. The nursing brassiere according to claim 5, wherein the nursing brassiere further comprises a pouch stitched to an outer surface of the fabric of the nursing brassiere, the pouch configured to receive and secure the casing.

7. The nursing brassiere according to claim 6, wherein the nursing brassiere further comprises:

a control panel operably coupled to the control unit and configured to receive a selection from predefined heating levels.

8. A method for increasing expression of breast milk, the method comprising:

providing a nursing brassiere comprising:

a left section configured to cover a left breast of a wearer, a right section configured to cover a right breast of the wearer, each of the left section and the right section has a hole configured to allow a flange of a breast pump to pass through and fit over the respective breast, and each of the left section and the right section has heating coils integrated within a fabric of the left section and the right section respectively, the heating coils are configured to apply therapeutic heat to the respective breast.

9. The method according to claim 8, wherein the heating coils are waterproofed.

10. The method according to claim 9, wherein the heating coils are stretchable.

11. The method according to claim 8, wherein the nursing brassiere further comprises:

an inlet port coupled to the heating coils of the left section and the right section; and a power supply configured to removably couple to the inlet port for powering the heating coils.

12. The method according to claim 11, wherein the nursing brassiere further comprises:

a casing, wherein the power supply is encased within the casing, wherein the power supply comprises one or more batteries; and a control unit encased within the casing, the control unit configured to control an amount of power supplied to the heating coils.

13. The method according to claim 12, wherein the nursing brassiere further comprises a pouch stitched to an outer surface of the fabric of the nursing brassiere, the pouch configured to receive and secure the casing.

14. The method according to claim 13, wherein the nursing brassiere further comprises:

a control panel operably coupled to the control unit and configured to receive a selection from predefined heating levels.

* * * * *